US006290404B1

(12) United States Patent
Twist et al.

(10) Patent No.: US 6,290,404 B1
(45) Date of Patent: Sep. 18, 2001

(54) PROCESSING SYSTEM AND METHOD WHICH INCLUDES HEAT RECOVERY AND REUSE IN A PHOTOGRAPHIC PROCESSING MACHINE

(75) Inventors: Peter J. Twist, Bucks; Nigel R. Wildman, Herts; Anthony Earle, Middlesex, all of (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/705,502

(22) Filed: Nov. 3, 2000

(51) Int. Cl.[7] ..... G03D 13/00; G03D 7/00
(52) U.S. Cl. ..... 396/571; 396/579
(58) Field of Search ..... 396/579, 636, 396/571; 355/27–28

(56) References Cited

U.S. PATENT DOCUMENTS

| | | | | |
|---|---|---|---|---|
| 3,995,298 | | 11/1976 | Vandeputte et al. | 396/626 |
| 4,791,444 | * | 12/1988 | Fujimoto et al. | 396/626 |
| 5,526,087 | * | 6/1996 | Suzuki et al. | 396/626 |
| 5,721,999 | * | 2/1998 | Calisto et al. | 396/627 |
| 5,739,896 | * | 4/1998 | Patton et al. | 355/27 |

FOREIGN PATENT DOCUMENTS

| | | |
|---|---|---|
| 3-266840 | 11/1991 | (JP) . |
| 9-258405 | 10/1997 | (JP) . |

* cited by examiner

*Primary Examiner*—D Rutledge
(74) *Attorney, Agent, or Firm*—David A. Novais

(57) ABSTRACT

The present invention relates to a processing system and method for photographic material which is adapted to use sources of heat within the processing machine for photographic processing purposes. More specifically, in the system and method of the present invention, sources of heat such as electrical, electro-mechanical and mechanical components and dryers can be utilized to provide heat in a small scale processor which uses a low volume of processing solution. Therefore, the arrangement of the present invention is designed in such a manner that permits the efficient use of heat produced as a by-product of an operation of these components. Furthermore, the arrangement of the present invention includes heat supplying members such as heaters and/or heat storage members to assist in supplying heat to those areas of the processors where the heat can be used for processing.

17 Claims, 2 Drawing Sheets

PROCESSING SYSTEM AND METHOD WHICH INCLUDES HEAT RECOVERY AND REUSE IN A PHOTOGRAPHIC PROCESSING MACHINE

FIELD OF THE INVENTION

The present invention relates generally to a processing method and system for photographic elements such as silver halide photographic elements, and particularly to the recovery and use of sources of heat within the processing machine as used for photographic processing purposes.

BACKGROUND OF THE INVENTION

It is desirable, especially with small scale dispersed photofinishing equipment or stand-alone equipment to reduce the heat consumption of the photographic processing machine. The benefit for the owner is lower operating costs and hence more profit per roll of film processed. Many processing machines in the marketplace today from large photofinishing machines to small microlabs have power saving features. The most prevalent is a standby mode for overnight periods, and periods of non-use. In this mode the chemical tank heaters are either switched off or operated at a lower temperature so that the tank can be returned to the processing temperature more quickly.

Heat from some sources within processing machines has been used to help perform other tasks within the machine. For example, a processing machine has been described in which at least one part of the heating section of a heat pump is utilized as a hot blower heating source of the drying section of the apparatus (JP 3266840A).

JP 9258405A describes an automated photographic processing apparatus in which waste liquid is evaporated and concentrated. Part of the heating air of a drying section is blown into the evaporator to accelerate the evaporation of the waste liquid.

U.S. Pat. No. 3,995,298 describes a photographic processing apparatus in which waste processing solutions are heated to evaporate them, the evaporated steam is condensed, providing heat to assist the drying of the photographic materials.

Despite these methods of saving heat, there remains the need to improve the recovery and reuse of heat by photographic processing machines. For example, heat that can be useful for photographic processing is often lost from several sources in the machine.

This invention describes processing machine designs that improve the recovery and reuse of heat by the machines where loss of heat from the processing machine is minimized.

SUMMARY OF THE INVENTION

An object of the present invention is to provide for a system and method in which warm air from at least a dryer used to dry processed photographic materials in the processing machine is used to provide heat to other components of the processor that require heat. These other components may include the chemical supply cartridges, a chemical heating module (if present) used to heat selected finite volumes of processing solutions prior to use in the processing machine, a hot air chamber (if present) within which the processing of photographic materials takes place, or a heat exchanger to provide heat to other components of the processing machine.

Materials with a high heat capacity (refractory materials such as those used in electric storage heaters) can be used in the processing machine to store heat for use at another time.

Heat from components of the processing machine that generate heat as a by-product of their operation can be stored in refractory materials for heat storage or conveyed and used to help keep other processor components warm that are required to be warm or hot during photographic processing. Such by-product heat generating components include transformers, power supplies, pumps, dryers, and circuit boards.

Less heat is required to process photographic material in small scale processors such as the processor described in GB 0023091.2. Small scale processors tend to use very small volumes of processing solutions to process photographic material. For example, in some cases, only a few milliliters of solution is used. Therefore, the heat required to bring the solution to processing temperature is very small. A significant proportion of the heat for such small volumes can be provided by other sources of heat in the equipment. Some small scale processors also tend to have a hot air enclosure to heat it. Prevention of heat loss by lagging (insulating) prevents the wasteful loss of heat. The lower heat capacity of air compared to water means that less heat is required to reach the desired temperature for the processing of photographic material.

The present invention therefore relates to a processing arrangement which comprises: a processor adapted to process photographic material, with the processor being located in a first enclosure; a dryer adapted to dry the processed photographic material; a first heated air delivery system adapted to provide a first heated air from the dryer to the first enclosure; operational components adapted to be used during at least a processing of the photographic material, with the operational components producing a second heated air as a by-product of their operation; and a second heated air delivery system adapted to provide the second heated air to the first enclosure.

The present invention further relates to a method of recovering and/or reusing heat generated as a by-product of processing photographic material which comprises: introducing a first heated air from a dryer which is adapted to dry processed photographic material into a first enclosure, with the first enclosure including at least a processor for processing the photographic material; and introducing a second heated air into the first enclosure, with the second heated air being produced as a by-product of an operation of at least one of electrical, mechanical or electro-mechanical components which are operative for at least the processing of the photographic material.

The present invention further relates to a processing arrangement which comprises: a processor adapted to process photographic material; a dryer adapted to dry the processed photographic material; and a heated air delivery system adapted to provide heated air from the dryer to at least an enclosure which includes the processor.

DETAILED DESCRIPTION OF THE INVENTION

In photofinishing processors, the dryer represents the largest waste of heat in the processing machine. Usually dryers are of the hot air type and dry colder air is heated to between 50–80° C., though some have been described that use radiant heat. The hot air provides the latent heat of evaporation needed to remove the water from the film or photographic material, in so doing it is cooled and leaves the dryer between 40–60° C. In a feature of the present invention, such warm air can be ducted over the chemical supply cartridges to help heat the chemical solutions for use in the processor. In a further feature of the invention, warm air from the dryer can be ducted through the chemical heating module used to heat selected volumes of processing solutions prior to use in the processing machine. Further, the air from the dryer can be directed into a lagged (insulated) hot air enclosure of a processor, which has a hot air enclosure to provide the hot temperature environment for photographic processing to take place. Warm air from the dryer can also be passed through a heat exchanger to supply heat to other needed areas within the processor.

Figure 1:
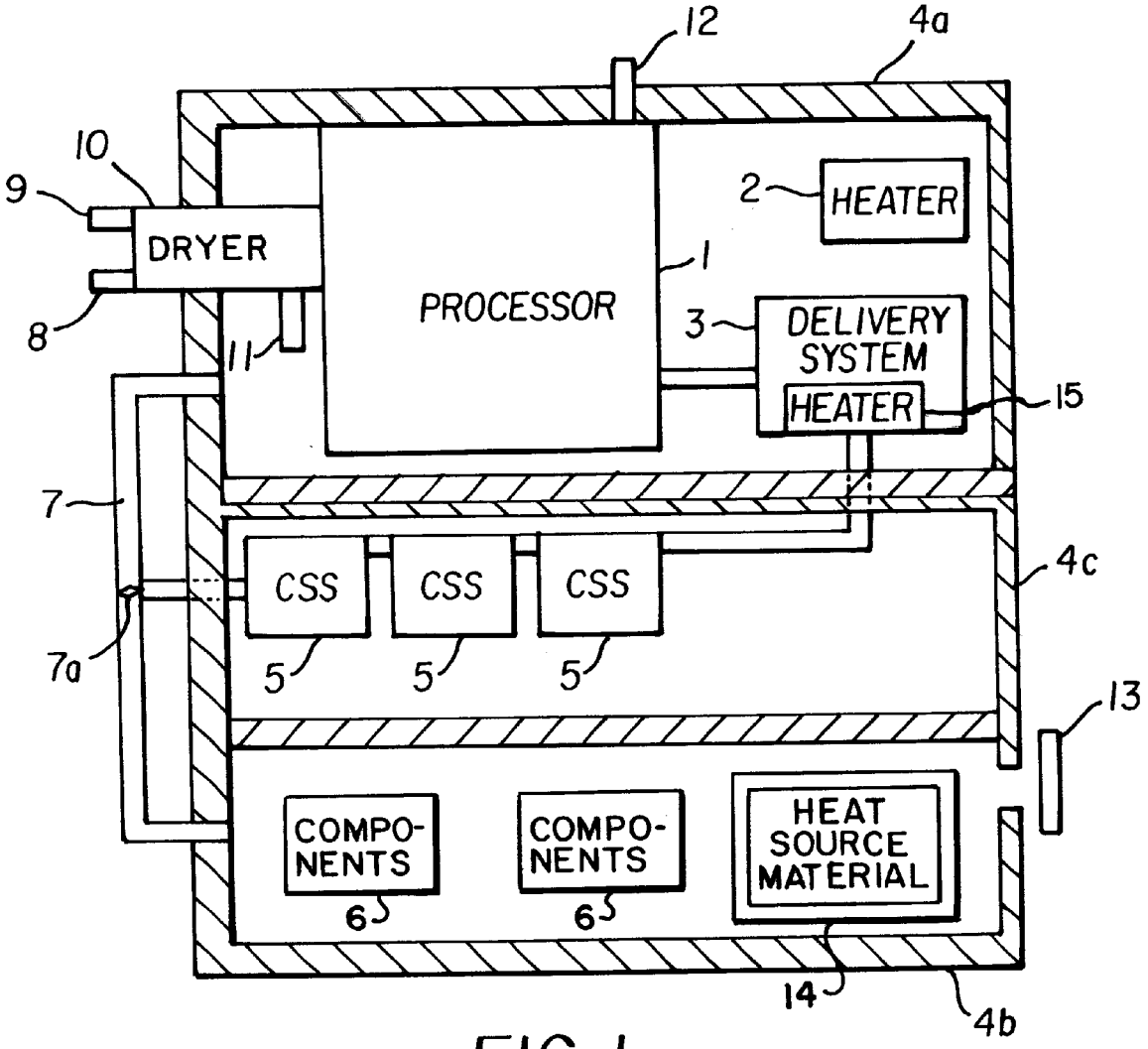
FIG. 1 shows a first embodiment of a processing arrangement in accordance with the present invention.

Referring now to drawings, wherein like reference numerals represent similar or identical parts throughout the several views, FIG. 1 shows a photographic material processor (1) equipped with a photographic material entrance (12) and an exit (8) from a dryer (10). In the system of the present invention, processor (1) and optionally a chemical metering and delivery system (3) heated by a heater (15), are positioned within a lagged (insulated) first enclosure (4*a*) which is heated by a heater (2). Electrical, electromechanical and mechanical components 6 (i.e., transformers, power supplies, pumps and circuit boards) can be positioned in a second insulated enclosure (4*b*). Heat as by-product of an operation of components (6) can be used to assist heating of a photographic processing chemical supply system (5) positioned in a third insulated enclosure (4*c*) or to assist heating the air within first insulated enclosure (4*a*) by means of a heated air delivery system in the form of a duct (7). This can aid in the heating of the small volumes of processing solutions used for processing. Duct (7) can include a directional valve (7*a*) which can selectively direct heated air to any of the enclosures (4*a*, 4*b*, 4*c*).

Photographic material dryer (10) can also be used to heat the air in any of the enclosures (4*a*, 4*b*, 4*c*), chemical supply system 5 by means of flow through duct (7), or the small volumes of processing solutions used for processing at metering system (3). Dryer 10 includes a heated air delivery system which heats cooler air drawn into it from inlet (9) and expells hot air into enclosure (4*a*) from exit (11). Inlet (9) is shown outside enclosure (4*a*), but optionally it may be within enclosure (4*a*). An amount of refractory, heat storing material (14) can also be incorporated in the processor within enclosure (4*b*) to store heat for later use when needed. Heat can be supplied to it from dryer 10 via duct (7), or from electrical components (6). A vent (13) for the escape of excess heat if necessary is provided in the processor. The very low volumes of processing chemical solutions that need to be heated in metering system (3) also minimize heat consumption of the processor.

Figure 2:
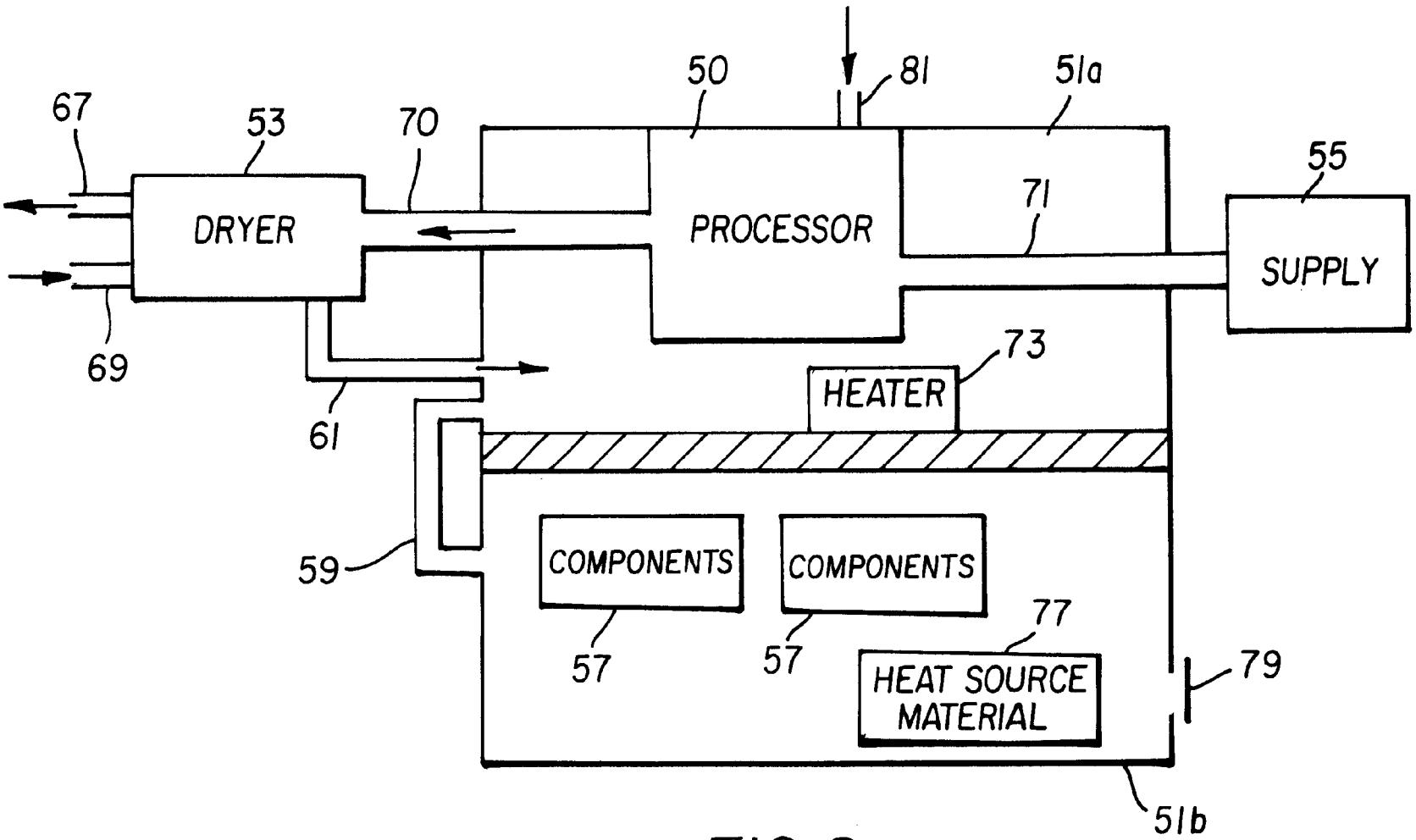
FIG. 2 shows a second embodiment of a processing arrangement in accordance with the present invention.

FIG. 2 illustrates a second embodiment of the arrangement of the present invention. The embodiment of FIG. 2 comprises first and second enclosures (51*a*), (51*b*). First enclosure (51*a*) includes a processor (50) therein. Unlike the embodiment of FIG. 1, in the embodiment of FIG. 2, the dryer and chemical supply metering system is placed outside of enclosure (51*a*) while the electrical, electro-mechanical or mechanical components and a heat storing material medium are placed in enclosure (51*b*). Therefore, in the embodiment of FIG. 2, film is introduced into processor (50) by way of film input (81). After processing, the film is lead to a dryer (53) via a conveying path (70). As indicated above, dryer (53) is located outside of enclosure (51*a*). After drying, the film is lead out of dryer (53) by way of outlet (67). In one feature of the invention, dryer (53) includes an air inlet (69) as well as an air outlet (61). After passing through dryer (53), air coming out air outlet (61) is introduced into enclosure (51*a*) as warm air. The warm air alone or in combination with a heater (75) in enclosure (51*a*) is effective to provide heat to enclosure (51*a*), including the components such as processor (50) provided in enclosure (51*a*). Like the embodiment of FIG. 1, enclosure (51*a*) can be an insulated enclosure.

In a further feature of the embodiment of FIG. 2, electrical, electro-mechanical and mechanical components (57) can be provided in insulated enclosure (5*b*). Also, a heat storage material (77) can also be provided in enclosure (51*b*). With the embodiment of FIG. 2, any heat generated by components (57) and/or stored in heat storage material (77) can be provided to enclosure (51*a*) via a heated air delivery system which includes a duct (59). Again, this can assist in heating the elements within enclosure (51*a*). Further, unlike the embodiment of FIG. 1, in the embodiment of FIG. 2, a chemical supply system (55) can be provided on an exterior of enclosure (51*a*). With the embodiment of FIG. 2, the warm air assists in heating for example, a duct (71) and optionally a metering system which delivers processing solution to processor (50). A vent (79) is useful for the escape of any excess heat if necessary. Further, like the embodiment of FIG. 1, the low volume of processing chemical solutions that are required for a small scale processor minimizes heat consumption of the processor.

In the present invention, heat storage materials (14, 77) with a high heat capacity (refractory materials such as those used in electric storage heaters) can be used in the processing machine to store heat for use at another time. This is beneficial if electricity to produce heat is more expensive to use at one time of day or week than at another time. The refractory materials can be heated up at times of the day or week when electricity is cheaper and then used to supply supplemental heat to the processing machine as needed when electricity is more expensive.

As shown in FIG. 1, processing machines have many components that use heat and produce heat as a by-product of their operation. In the present invention, this heat is captured and used to help keep other processor components warm that are required to be warm or hot. Transformers, power supplies, pumps, dryers, and circuit boards are all sources of heat as a by-product and can be positioned in the processing machine to help heat usage by supplying supplemental heat to heat-requiring components such as the chemical supply cartridges, a chemical heating module (if present) used to heat selected finite volumes of processing solutions prior to use in the processing machine, a hot air chamber (if present) within which the processing of photographic materials takes place, or a dryer used to dry photographic materials after processing. Alternatively, the heat from these sources can be used to heat a refractory heat storage material for storage and use at a later time.

Processing tanks or containers in which photographic materials are processed contain a volume of processing liquid usually heated to a controlled temperature above ambient room temperature. This volume can range broadly from hundreds of liters down to several hundred milliliters. The volume of aqueous solution to be heated has a heat capacity, and the heat required to raise its temperature is proportional to the volume being heated. Small volume tanks are therefore heat efficient. In small scale processors that use small volumes of processing solutions once to process photographic material only a few milliliters of processing solution (a volume approximately the same as that of the replenishment volume required to process the film in a conventionally replenished processor) is used. In such a small scale processor the heat required to warm the solution (a few milliliters) is very small in comparison to a conventional processing tank or even a low volume thin tank. The heat for such small volumes can be provided to a significant proportion from other sources of heat in the equipment. Some small scale processors also have hot air enclosure to heat it. Prevention of heat loss by lagging (insulating) prevents the wasteful loss of heat. As air has a lower heat capacity than water it takes less heat to reach the desired temperature for the processing of photographic material.

The invention has been described in detail with particular reference to certain preferred embodiments thereof, but it will be understood that variations and modifications can be effected within the spirit and scope of the invention.

What is claimed is:

1. A processing arrangement comprising:

a processor adapted to process photographic material, said processor being located in a first enclosure;

a dryer adapted to dry the processed photographic material;

a first heated air delivery system adapted to provide a first heated air from the dryer to the first enclosure;

operational components adapted to be used during at least a processing of the photographic material, said operational components producing a second heated air as a by-product of their operation; and a second heated air delivery system adapted to provide the second heated air to the first enclosure.

2. A processing arrangement according to claim 1, wherein said operational components comprise at least one of electrical, mechanical or electro-mechanical components and are located in a second enclosure.

3. A processing arrangement according to claim 2, wherein said second heated air delivery system comprises a duct which extends from the second enclosure to the first enclosure.

4. A processing arrangement according to claim 2, further comprising:

a processing solution metering system adapted to meter the delivery of processing solution to the processor.

5. A processing arrangement according to claim 4, further comprising:

a heater for heating at least one of the first enclosure and the processing solution metering system.

6. A processing arrangement according to claim 4, further comprising:

a processing solution supply system located in a third enclosure and in fluid communication with said processing solution metering system.

7. A processing arrangement according to claim 6, wherein said second heated air delivery system is further adapted to provide said second heated air to the third enclosure.

8. A processing arrangement according to claim 2, further comprising:

a heat storage material provided in said second enclosure.

9. A processing arrangement according to claim 2, wherein at least said first and second enclosures are insulated.

10. A method of recovering and/or reusing heat generated as a by-product of processing photographic material comprising:

introducing a first heated air from a dryer which is adapted to dry processed photographic material into a first enclosure, the first enclosure including at least a processor for processing the photographic material; and introducing a second heated air into said first enclosure, said second heated air being produced as a by-product of an operation of at least one of electrical, mechanical or electro-mechanical components which are operative for at least the processing of the photographic material.

11. A method according to claim 10, wherein the components are located in a second enclosure and said second heated air is introduced into said first enclosure by way of an air duct.

12. A method according to claim 11, further comprising: heating at least one of said first enclosure or a processing solution metering system by positioning a heat source in said first enclosure.

13. A method according to claim 12, further comprising: locating a processing solution supply system in a third enclosure, the processing solution supply system being in fluid communication with the processing solution metering system for delivering processing solution to the processor.

14. A method according to claim 13, further comprising: introducing the second heated air into the third enclosure having said processing solution supply system.

15. A method according to claim 13, further comprising: locating a heat storage material in at least the third enclosure.

16. A method according to claim 11, further comprising: insulating at least the first and second enclosures.

17. A processing arrangement comprising:

a processor adapted to process photographic material;

a dryer adapted to dry the processed photographic material; and a heated air delivery system adapted to provide heated air from the dryer to at least an enclosure which includes the processor.

* * * * *